US006508048B2

(12) United States Patent
Panneri

(10) Patent No.: US 6,508,048 B2
(45) Date of Patent: Jan. 21, 2003

(54) BANDING FIXTURE

(75) Inventor: Alfred J. Panneri, Cheektowaga, NY (US)

(73) Assignee: A. J. Panneri Enterprises, Inc., Cheektowaga, NY (US)

( * ) Notice: Subject to any disclaimer, the term of this patent is extended or adjusted under 35 U.S.C. 154(b) by 96 days.

(21) Appl. No.: 09/732,661

(22) Filed: Dec. 8, 2000

(65) Prior Publication Data

US 2002/0069613 A1 Jun. 13, 2002

(51) Int. Cl.[7] ..... B65B 13/02

(52) U.S. Cl. ..... 53/586; 53/590; 100/10; 100/26

(58) Field of Search ..... 53/586, 589, 590; 100/10, 25, 26

(56) References Cited

U.S. PATENT DOCUMENTS 3,021,653 A * 2/1962 Marshall ..... 53/586
4,162,600 A * 7/1979 Westall et al. ..... 53/590
4,570,442 A * 2/1986 Watanabe et al. ..... 53/586
4,783,948 A * 11/1988 Kando ..... 53/586
4,832,767 A * 5/1989 Eller ..... 53/586
4,852,329 A * 8/1989 Terragnoli ..... 53/399
4,875,325 A * 10/1989 Gamberini et al. ..... 53/586
4,930,293 A * 6/1990 Hanscom ..... 53/590
5,063,803 A * 11/1991 Panneri et al. ..... 53/586

OTHER PUBLICATIONS

Previous banding fixture, no date.

* cited by examiner

*Primary Examiner*—Stephen F. Gerrity
(74) *Attorney, Agent, or Firm*—Joseph P. Gastel

(57) ABSTRACT

A banding fixture including a body having a horizontal opening therein, a carriage movable into and out of the horizontal opening, a recess in the carriage, the carriage with the recess therein movable into the horizontal opening with an upper surface on the carriage in underlying near contiguous relationship to an undersurface of a plate on the body, and a workpiece-receiving slot in the body above the horizontal opening. A method of banding a workpiece including the steps of placing a band into spaced slots having sides, pressing a workpiece overlying a central portion of the band which is not in the slots into a recess in a member, and moving the member relative to a surface so that the ends of the band which extend beyond the workpiece are pressed together in overlapping relationship as the member passes in contiguous relationship to the surface.

21 Claims, 4 Drawing Sheets

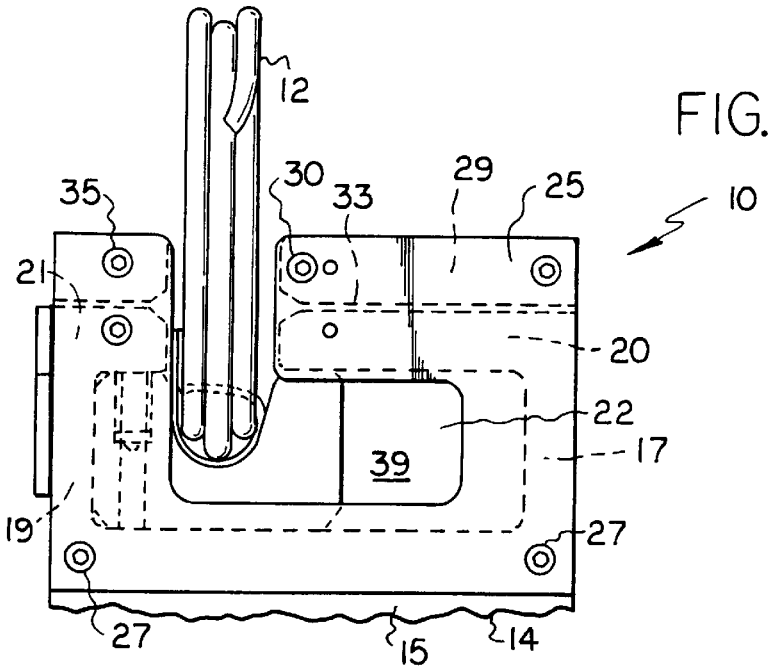
FIG. 9
FIG. 2A
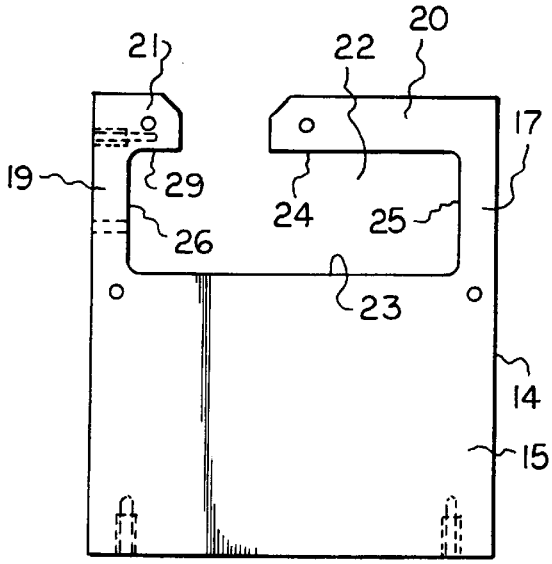
FIG. 2C
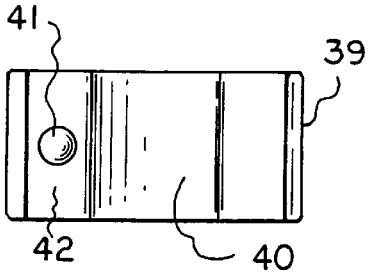
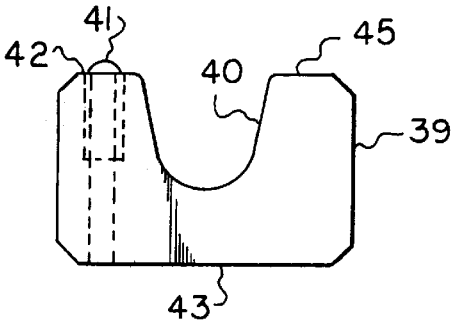
FIG. 2B

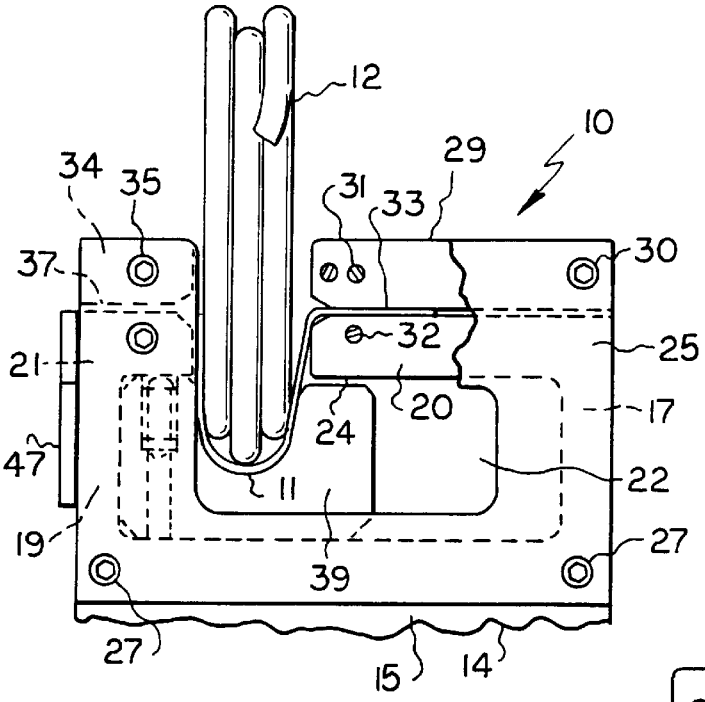
FIG. 6
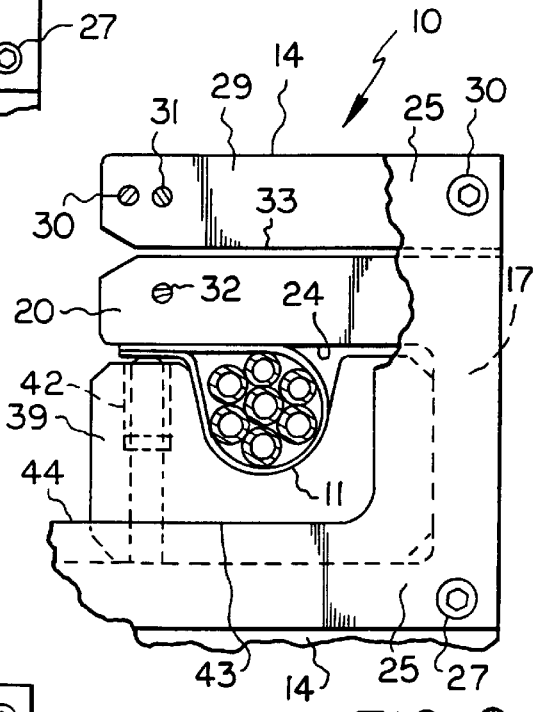
FIG. 8
FIG. 7
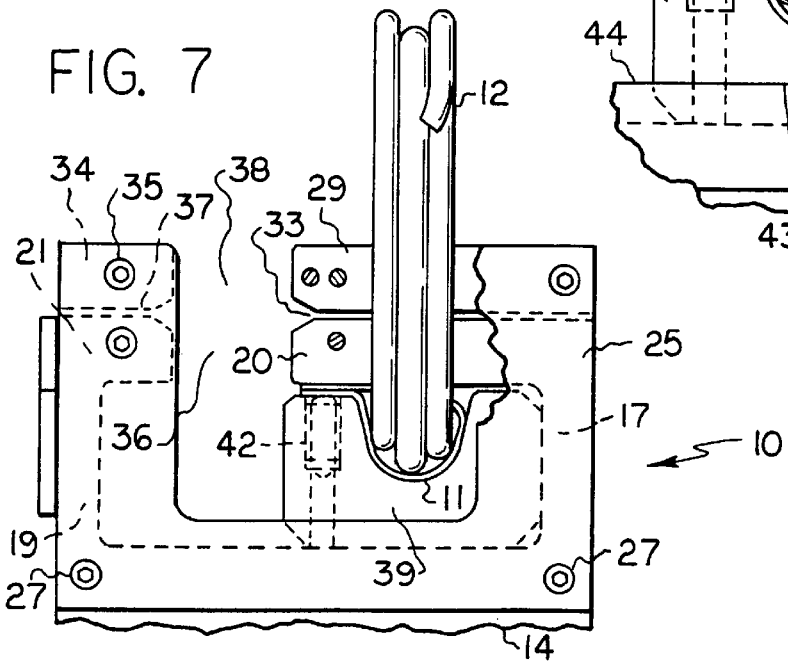

BANDING FIXTURE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention relates to an improved banding fixture for applying a band to a coil or bundle of material and to an improved banding method.

By way of background, a workpiece, such as coiled material or a bundle of material, require bands to retain them in assembled condition. It is also desirable that the ends of the band which cohere to each other be in as close overlapping alignment as possible so that any of the surfaces which should adhere to each other are not exposed.

BRIEF SUMMARY OF THE INVENTION

It is the object of the present invention to provide a banding fixture for material which has to be banded which accepts a predetermined length of band and guides this band during a manually manipulatable operation about a coil or bundle and causes the ends of the band to be secured to each other in substantially exact overlying relationship.

It is another object of the present invention to provide an improved simple and efficient method for applying a band about a workpiece. Other objects and attendant advantages of the present invention will readily be perceived hereafter.

The present invention relates to a banding fixture comprising a body, a horizontal opening in said body, an overlying portion on said body overlying said horizontal opening, an undersurface on said overlying portion, a carriage movable into and out of said horizontal opening, a recess in said carriage, first and second carriage portions on opposite sides of said recess, an upper surface on at least one of said first and second carriage portions positioned in underlying near contiguous relationship with said undersurface when said recess underlies said overlying portion, and a band-receiving slot in said body above said horizontal opening.

The present invention also relates to a method of banding a workpiece comprising the steps of providing a length of band having a central portion and outer end portions and longitudinal sides and a side with a cohesive substance thereon, placing said length of band between side members with said longitudinal sides adjacent said side members, providing a workpiece having an outer side with adjacent sides proximate said outer side and an inner side opposite to said outer side, positioning said workpiece with said outer side on said central portion of said band having said cohesive substance thereon, moving said workpiece and said band into a recess in a member to cause portions of said central portion of said band to move alongside said adjacent sides and to cause an additional portion of said central portion and one of said end portions adjacent said additional portion to extend beyond said one of said adjacent sides and to cause the other of said end portions to extend beyond the other of said adjacent sides, and moving said member past a second surface to cause said additional portion of said central portion of said band to extend across said inner surface and to cause said end portions of said band to lie in pressed cohesive engagement between said second surface and a third surface which is adjacent to said recess.

The various aspects of the present invention will be more fully understood when the following portions of the specification are read in conjunction with the accompanying drawings wherein:

BRIEF DESCRIPTION OF THE SEVERAL VIEWS OF THE DRAWING

FIG. 2A is a side elevational view of the body of the fixture;

FIG. 2B is a side elevational view of the carriage;

FIG. 2C is a plan view of the carriage;

FIG. 6 is a view similar to FIG. 5 but showing the coil moved into the carriage on the fixture;

FIG. 7 is a view similar to FIG. 6 but showing the carriage moved to a position wherein the band has been installed about the coil;

FIG. 8 is an enlarged fragmentary view similar to FIG. 7 but showing the coil in cross section with the band installed thereon; and FIG. 9 is a view similar to FIG. 7 but showing the carriage moved to a position which permits the banded coil to be removed from the fixture.

DETAILED DESCRIPTION OF THE INVENTION

Figure 1:
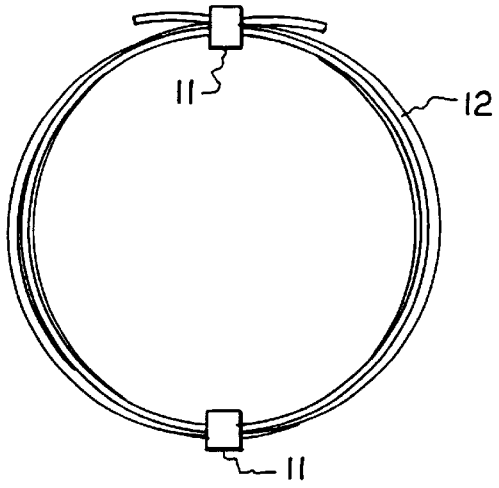
FIG. 1 is a side elevational view of a coil of tubing which is banded by bands which have been applied by the present banding fixture.

Summarizing briefly in advance, the banding fixture 10 and method of banding are for applying bands 11 to a workpiece such as a coil 12 of tubing or any other type of coiled material or material to be banded. The bands 11 are received in a predetermined length from a banding machine of any type which can supply it. Each band, by the use of fixture 10, can then be banded about the coiled material.

The banding fixture 10 includes a body 14 fabricated out of a suitable plastic material. Body 14 includes a lower plastic portion 15 (FIG. 2A) of substantially rectangular configuration. Formed integrally with lower portion 15 are two narrow members 17 and 19. Member 17 merges into a horizontal member 20 and member 19 merges into a horizontal member 21. A horizontal opening 22 (FIGS. 2 and 2A) is defined by edge 23 (FIG. 2A) of lower body member 15, edge 24 of member 20, edge 25 of member 17, edge 27 of member 19 and edge 29' of member 21.

Metal plates 25 are screwed to body 14 by screws 27. A substantially rectangular block 29 (FIG. 2) is secured between plates 25 by screws 30 and by a plastic pin 31. A plastic pin 32 also extends through plates 25 and body portion 20. A band-receiving slot 33 is thus formed between block 29 and body portion 20. A second block 34 is secured between plates 25 by screws 35. A slot 37 is located between body portion 21 and block 34.

Figure 2:
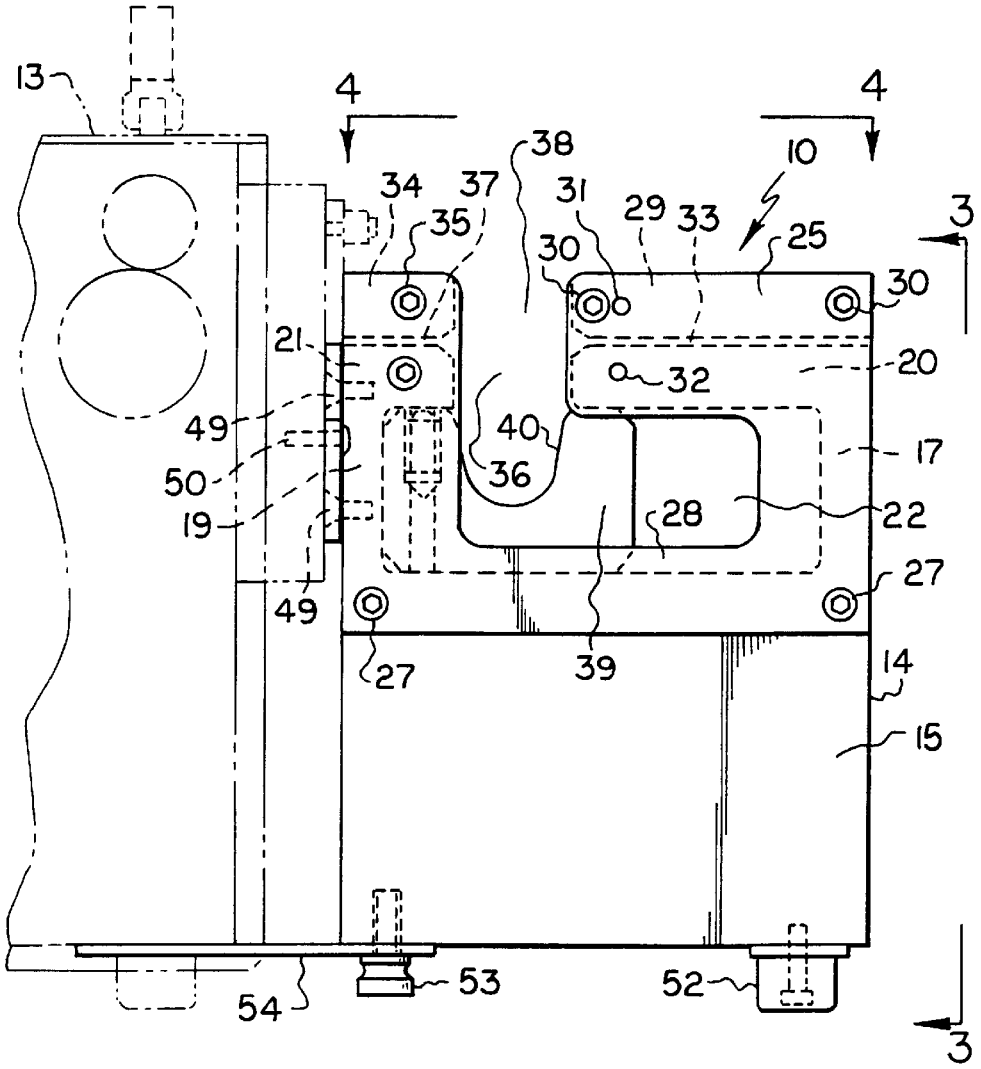
FIG. 2 is a side elevational view of the banding fixture attached to a machine which supplies bands of a desired length.
Figure 3:
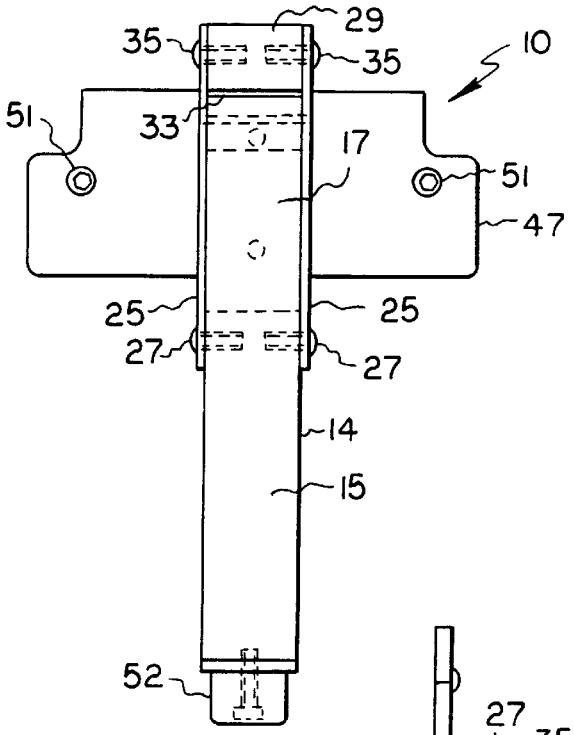
FIG. 3 is an end elevational view taken substantially in the direction of arrows 3—3 of FIG. 2.
Figure 4:
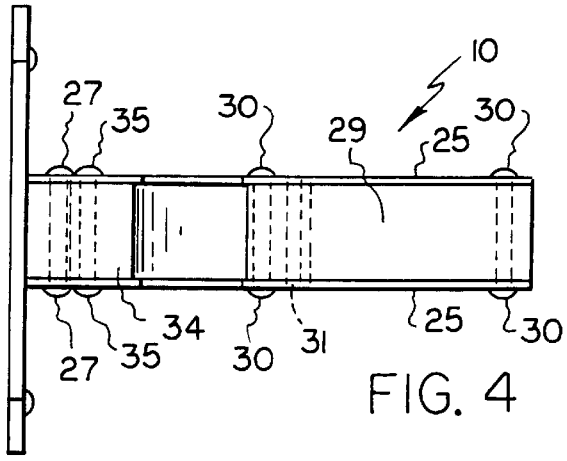
FIG. 4 is a plan view of the fixture taken substantially in the direction of arrows 4—4 of FIG. 2.

A carriage 39 is positioned in horizontal opening 22 for sliding movement between its position shown in FIG. 2 and the position shown in FIGS. 7 and 8. Carriage 39 (FIGS. 2B and 2C) is a plastic block of substantially solid rectangular configuration having a recess 40 therein. Also, a spring-biased ball 41 protrudes from the upper surface 42 of carriage 39. The bottom surface 43 (FIGS. 2B and 8) of carriage 39 slides on surface 23 of body 14, and the top surfaces 45 and 42 (FIG. 2B) travel in close relationship to surfaces 24 and 29 (FIG. 2A) of body 14. As can be seen from FIGS. 2 and 5, the edges 28 of plates 25 which are adjacent to and surround horizontal opening 22 confine carriage 39 for rectilinear movement within horizontal opening 22. A plate 47 (FIG. 3) is secured to body 14 by screws 49 and plate 47 is for securing the fixture 14 to the band-dispensing machine 13 by screws 50 which pass through apertures 51 in plate 47. A leg 52 extends downwardly from body 14 for supporting body 14 on a suitable surface. Also, a screw 53 is threaded into body 14 to support a plate 54 which is attached to the band-dispensing machine 13.

Figure 5:
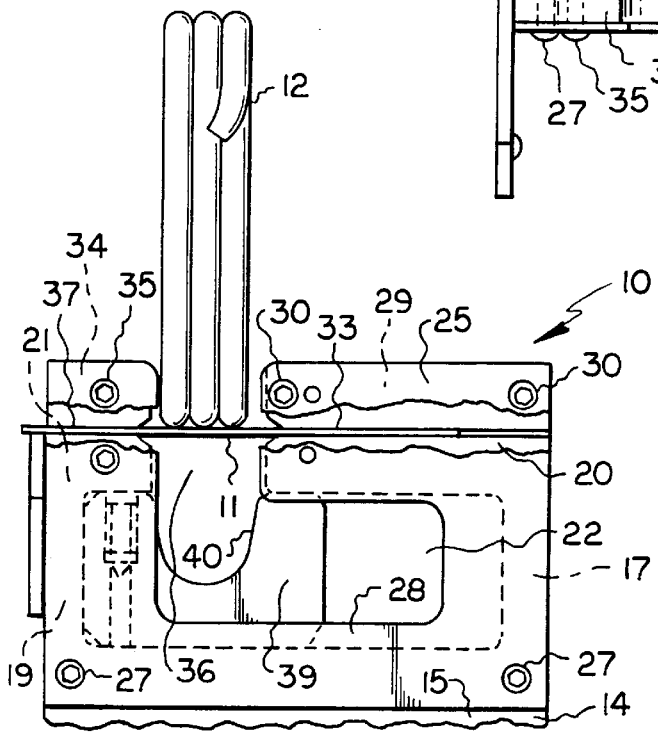
FIG. 5 is a fragmentary side elevational view showing a band in position on the fixture and a coil of tubing at an initial position for subsequent banding.

In operation, a band 11 having a cohesive coating on its upper surface is dispensed from band-dispensing machine into band-receiving slots 37 and 33 and confined against lateral movement by plates 25 on opposite sides of slots 37 and 33. The band 11 is dispensed to a position as shown in FIG. 5 wherein its central portion lies across workpiece-receiving slot 36 in body 14 above the recess 40 in carriage 39. The band 11 is positioned so that after it has been banded about coil 12, its ends will be in perfect overlying relationship as shown in FIG. 8. The workpiece coil 12 is thereafter manually initially positioned in slot 38 between body members 29 and 34 over the central portion of band 11, as shown in FIG. 5, and moved downwardly with the adjacent central band portion of band 11 through slot 36 and into recess 40 of carriage 39, as shown in FIG. 6. Slots 36 and 38, which extend transversely to band-receiving slots 37 and 33, can be considered separately and jointly as a coil-receiving slot, and more broadly as workpiece-receiving slots. When the coil is in the recess 40, portions of the central portion of band 11 will lie along the sides of the coil which are adjacent the lower side of the coil in the lowermost part of recess 40 (FIG. 6). Thereafter, the carriage 39 is manually moved to the position shown in FIG. 7 wherein the ends of band 11 are pressed together between spring-biased ball 41 and the undersurface 24 of member 20 so that the band 11 assumes the condition shown in FIG. 8. During the movement of the carriage 39 into horizontal opening 22 to the position of FIG. 7, a portion of the central portion of band 11 to the right of the coil 12 in FIG. 6 will be moved across the inner side of the coil, and the end portions of the band will be placed in overlapping pressed relationship. Thereafter, the carriage 39 is moved to the position of FIG. 9 whereupon the coil 12 can be withdrawn. Because the band 11 which is used is of the cohesive type, the surfaces of the band which are pressed together will cohere to each other but the band itself will not adhere to anything else. Because the band 11 is confined against lateral movement in slots 37 and 33 by plates 25 during the banding process, the end portions of the band which cohere to each other will be in exact overlying relationship with all of their edges being perfectly aligned with each other. However, while the side edges of the band are in exact alignment because of the above-noted confinement against lateral movement in slots 37 and 33, under certain circumstances the extreme outer edges on the ends may not be in alignment, depending on the initial placement of the band.

Slots 36 and 38 were designated above as workpiece-receiving slots. In this respect, while the workpiece which was illustrated is a coil 12, it will be appreciated that the designation "workpiece-receiving slot" can include a bundle of material which is not in coil form and a single object to which a band has to be applied.

While preferred embodiments of the present invention have been disclosed, it will be appreciated that the present invention is not limited thereto but may be otherwise embodied within the scope of the following claims.

What is claimed is:

1. A banding fixture comprising a body, a horizontal opening in said body, an overlying portion on said body overlying said horizontal opening, an undersurface on said overlying portion, a carriage movable into and out of said horizontal opening, a recess in said carriage, first and second carriage portions on opposite sides of said recess, an upper surface on at least one of said first and second carriage portions positioned in underlying near contiguous relationship with said undersurface when said recess underlies said overlying portion, and a band-receiving slot in said body above said horizontal opening.

2. A banding fixture as set forth in claim 1 including a workpiece-receiving slot in said body extending transversely to said band-receiving slot.

3. A banding fixture as set forth in claim 2 wherein said workpiece-receiving slot includes a first workpiece-receiving slot portion above said band-receiving slot, and a second, workpiece-receiving slot portion below said band-receiving slot.

4. A banding fixture as set forth in claim 2 wherein said band-receiving slot includes a first band-receiving slot portion on one side of said workpiece-receiving slot and a second band-receiving slot portion on the other side of said workpiece-receiving slot.

5. A banding fixture as set forth in claim 4 wherein said workpiece-receiving slot includes a first workpiece-receiving slot portion above said band-receiving slot, and a second workpiece-receiving slot portion below said band-receiving slot.

6. A banding fixture as set forth in claim 2 wherein said workpiece-receiving slot comprises a slot between said band-receiving slot and said horizontal opening.

7. A banding fixture as set forth in claim 6 wherein said band-receiving slot comprises a slot on one side of said workpiece-receiving slot.

8. A banding fixture as set forth in claim 1 wherein the other of said first and second carriage portions is in underlying relationship with said undersurface when said recess is not in underlying relationship to said overlying portion.

9. A banding fixture as set forth in claim 8 including a workpiece-receiving slot in said body extending transversely to said band-receiving slot.

10. A banding fixture as set forth in claim 9 wherein said workpiece-receiving slot includes a first workpiece-receiving slot portion above said band-receiving slot, and a second workpiece-receiving slot portion below said band-receiving slot.

11. A banding fixture as set forth in claim 9 wherein said band-receiving slot includes a first band-receiving slot portion on one side of said workpiece-receiving slot and a second band-receiving slot portion on the other side of said workpiece-receiving slot.

12. A banding fixture as set forth in claim 11 wherein said workpiece-receiving slot includes a first workpiece-receiving slot portion above said band-receiving slot, and a second, workpiece-receiving slot portion below said band-receiving slot.

13. A banding fixture as set forth in claim 9 wherein said workpiece-receiving slot comprises a slot between said band-receiving slot and said horizontal opening.

14. A banding fixture as set forth in claim 13 wherein said band-receiving slot comprises a slot on one side of said workpiece-receiving slot.

15. A banding fixture as set forth in claim 1 including a second upper surface on said other of said first and second carriage portions, and wherein both said upper surface and said second upper surface are in underlying relationship to said undersurface when said recess is in underlying relationship to said overlying portion.

16. A banding fixture as set forth in claim 15 including a workpiece-receiving slot in said body extending transversely to said band-receiving slot.

17. A banding fixture as set forth in claim 16 wherein said workpiece-receiving slot includes a first workpiece-receiving slot portion above said band-receiving slot, and a second workpiece-receiving slot portion below said band-receiving slot.

18. A banding fixture as set forth in claim 16 wherein said band-receiving slot includes a first band-receiving slot portion on one side of said workpiece-receiving slot and a second band-receiving slot portion on the other side of said workpiece-receiving slot.

19. A banding fixture as set forth in claim 18 wherein said workpiece-receiving slot includes a first workpiece-receiving slot portion above said band-receiving slot, and a second workpiece-receiving slot portion below said band-receiving slot.

20. A banding fixture as set forth in claim 16 wherein said workpiece-receiving slot comprises a slot between said band-receiving slot and said horizontal opening.

21. A banding fixture as set forth in claim 20 wherein said band-receiving slot comprises a slot on one side of said workpiece-receiving slot.

* * * * *